US011952991B2

(12) United States Patent
Wu et al.

(10) Patent No.: US 11,952,991 B2
(45) Date of Patent: Apr. 9, 2024

(54) PISTON AND VALVE SHEET ARRANGEMENT IN COMPRESSOR ASSEMBLY FOR REFRIGERATION DEVICE

(71) Applicant: ANHUI MEIZHI COMPRESSOR CO., LTD., Anhui (CN)

(72) Inventors: Wenjie Wu, Anhui (CN); Gang Huang, Anhui (CN)

(73) Assignee: ANHUI MEIZHI COMPRESSOR CO., LTD., Anhui (CN)

( * ) Notice: Subject to any disclaimer, the term of this patent is extended or adjusted under 35 U.S.C. 154(b) by 130 days.

(21) Appl. No.: 17/525,494

(22) Filed: Nov. 12, 2021

(65) Prior Publication Data

US 2022/0099078 A1 Mar. 31, 2022

Related U.S. Application Data

(63) Continuation of application No. PCT/CN2021/085684, filed on Apr. 6, 2021.

(30) Foreign Application Priority Data

Sep. 30, 2020 (CN) ..... 202011067672.6
Sep. 30, 2020 (CN) ..... 202022212889.3

(51) Int. Cl.
*F04B 39/10* (2006.01)
*F04B 39/00* (2006.01)

(52) U.S. Cl.
CPC ..... *F04B 39/1073* (2013.01); *F04B 39/0016* (2013.01)

(58) Field of Classification Search
CPC ..... F04B 39/0016; F04B 39/1066; F04B 39/1073
See application file for complete search history.

(56) References Cited

U.S. PATENT DOCUMENTS 5,454,397 A * 10/1995 Miszczak ..... F04B 39/1073 137/856
5,609,476 A * 3/1997 Kim ..... F04B 39/1073 417/447

(Continued)

FOREIGN PATENT DOCUMENTS

BR 8901558 A 11/1989
CN 1356474 A 7/2002

(Continued)

OTHER PUBLICATIONS

Supplementary European Search Report dated Aug. 2, 2022 received in European Patent Application No. EP 21799160.3.

(Continued)

*Primary Examiner* — Nathan C Zollinger
(74) *Attorney, Agent, or Firm* — Scully, Scott, Murphy & Presser, P.C.

(57) ABSTRACT

A piston assembly for a compressor assembly is provided. The piston assembly has a piston and a valve sheet. The valve sheet is arranged at an end of the piston. The valve sheet has a valve sheet body with a mounting port, and a valve tongue connected to the valve sheet body. At least part of the valve tongue is arranged in the mounting port. At least part of a contour of the mounting port matches with a circumferential contour of one end of the piston close to the valve sheet.

7 Claims, 8 Drawing Sheets

(56) References Cited

U.S. PATENT DOCUMENTS

| | | | | |
|---|---|---|---|---|
| 6,540,492 | B2 * | 4/2003 | Kaido | F04B 39/1073 417/571 |
| 2002/0173774 | A1 | 11/2002 | Olsen | |
| 2012/0014821 | A1 * | 1/2012 | Hikichi | F04B 53/14 417/415 |
| 2022/0356872 | A1 * | 11/2022 | Schneider | F04B 39/1066 |

FOREIGN PATENT DOCUMENTS

| | | | |
|---|---|---|---|
| CN | 1548741 | A | 11/2004 |
| CN | 1688813 | A | 10/2005 |
| CN | 110185596 | A | 8/2019 |
| CN | 110541803 | A | 12/2019 |
| DE | 1600739 | B1 | 7/1970 |

OTHER PUBLICATIONS

International Search Report and Written Opinion dated Jun. 30, 2021 received in International Application No. PCT/CN2021/085684 together with an English language translation.

* cited by examiner

PISTON AND VALVE SHEET ARRANGEMENT IN COMPRESSOR ASSEMBLY FOR REFRIGERATION DEVICE

CROSS-REFERENCE TO RELATED APPLICATIONS

The present application is a continuation application of PCT International Application No. PCT/CN2021/085684, filed on Apr. 6, 2021, which claims priority to and benefits of Chinese Patent Application No. 202011067672.6 filed with China National Intellectual Property Administration on Sep. 30, 2020 and entitled "PISTON ASSEMBLY, COMPRESSOR ASSEMBLY AND REFRIGERATION DEVICE" and Chinese Patent Application No. 202022212889.3 filed with China National Intellectual Property Administration on Sep. 30, 2020 and entitled "PISTON ASSEMBLY, COMPRESSOR ASSEMBLY AND REFRIGERATION DEVICE", the entire contents of which are herein incorporated by reference for all purposes. No new matter has been introduced.

FIELD

The present disclosure relates to the field of refrigeration device, and particularly, to a piston assembly, a compressor assembly and a refrigeration device.

BACKGROUND

In the prior art, the piston assembly in the compressor assembly and the valve tongue of the valve sheet are surrounded by a solid structure, which will be impacted by airflow during the work process, which is prone to generate large noises and affect the experience of using the compressor assembly.

SUMMARY

The present disclosure is directed to solve at least one of the technical problems existing in the prior art or the related art.

In view of this, the first aspect of an embodiment of the present disclosure provides a piston assembly.

The second aspect of an embodiment of the present disclosure provides a compressor assembly.

The third aspect of an embodiment of the present disclosure provides a refrigeration device.

In order to achieve the above objects, an embodiment of a first aspect of the present disclosure provides a piston assembly, comprising: a piston; and a valve sheet, being arranged at one end of the piston, wherein, the valve sheet comprises a valve sheet body with a mounting port and a valve tongue, the valve tongue is connected to the valve sheet body, and at least part of the valve tongue is arranged in the mounting port, wherein, at least part of a contour of the mounting port matches with a circumferential contour of one end of the piston close to the valve sheet.

The piston assembly provided by the embodiment of the first aspect of the present disclosure, including a piston and a valve sheet. The valve sheet comprises a valve sheet body and a valve tongue. The fluid flow can be controlled under the action of the piston, so that it is convenient to do work to achieve suction with the cooperation of the valve sheet. Because the valve sheet is arranged at one end of the piston, and its end surface is in contact with the valve sheet, it can intermittently inhale inward under the action of the valve tongue to achieve the normal operation of the piston assembly.

In order to ensure the normal operation of the valve tongue, when the valve sheet is arranged at one end of the piston, the valve tongue is located in the mounting port of the valve sheet body. By matching part or entire contour of the mounting port with the circumferential contour of one end of the piston close to the valve sheet, when the piston attaches the valve sheet, the piston can fit closely with the valve sheet to prevent fluid from passing through the gap. There is a valve tongue in the mounting port. When the valve tongue is opened, fluid can flow through the gap between the valve tongue and the piston. It should be emphasized that because the piston matches with the valve sheet, the gap between the valve tongue and the contour of the mounting port can be increased, and the valve sheet body will not generate vibration and noise due to excitation when the fluid flows. Furthermore, when the piston assembly is used for refrigeration device, because the piston and the valve sheet are closely matched, the clearance volume can be reduced, thereby increasing the cooling capacity, and the cooling performance can be improved.

Furthermore, one end of the piston close to the valve sheet matches with the contour of the mounting port. When the fluid passes through, the fluid can only pass through the mounting port. It can be understood that the larger the area where the fluid can flow in the mounting port, the smaller the excitation of the valve sheet when the fluid flows, and the smaller the noise of the valve sheet. Therefore, the mounting port should be provided as large as possible to reduce the noise generated when the fluid passes. The shape of the mounting port can also be configured according to actual needs.

It should be noted that the structure that matches with the end face of the piston can be a full mounting port or a part of the mounting port to achieve a close fit between the piston and the valve sheet.

The number of the mounting ports can be adaptively set according to actual use needs. It can be one or more to improve the utilization of valve sheet.

For example, the valve tongue can also be set to one or more to control independent fluid channels respectively.

Furthermore, the valve tongue can be configured to have different shapes according to actual needs. For example, the valve tongue can be rectangular, which is easy to process. However, when it is impacted by fluid, due to its wider junction with the valve sheet body, it requires a larger fluid impulse to push it away. It can also be configured to have a narrow top and a wide bottom. This shape is relatively easier to be opened by fluid, and is more suitable for the use of gas valve. Considering the actual application environment of the piston assembly, the size of the piston assembly installation space and other factors, it can be configured adaptively according to actual needs.

The valve tongue and the valve sheet body can be connected by welding. The valve tongue can be processed separately and then welded to the valve sheet. For example, it can also be a one-piece structure. This structure, relatively speaking, has higher connection strength and longer service life. In addition, the piston assembly in the above-mentioned solution provided by the present disclosure may also have the following additional technical features.

In the above-mentioned embodiments, one end of the piston close to the valve sheet is provided with a cooperating groove, and a shape of the cooperating groove matches with a shape of the valve tongue.

In this embodiment, it is limited to provide a cooperating groove at one end of the piston, and the shape of the cooperating groove is adapted to the shape of the valve tongue. Therefore, when the piston is installed on the mounting port, the valve tongue can be more completely embedded in the cooperating groove, and the valve sheet can be closely attached to the piston without leaving a gap between the two. In this way, when the valve tongue is opened and the fluid passes through, the fluid will not leak from the gap between the valve tongue and the piston, causing noise. At the same time, since the valve body is closely attached to the piston, all the fluid flowing from the mounting port can enter the piston. For the refrigeration device using piston assembly, the cooling capacity can be increased because the fluid can flow in more fully, and the double effect of noise reduction and improvement of cooling performance can be achieved.

In the above-mentioned embodiments, the thickness of the valve tongue is equal to the thickness of the cooperating groove.

In this embodiment, the thickness of the valve tongue and the cooperating groove is equal. When the valve tongue is closed, the valve tongue can be completely embedded in the cooperating groove. When the valve body is attached to the piston, there is no gap between the two and they can be closely attached to each other. For a refrigeration device, no fluid can be left between the valve tongue and the piston during operation, thereby increasing the cooling capacity.

In the above-mentioned embodiments, the valve tongue comprises: a connecting portion, being connected to the valve sheet body; and an extension portion, being arranged in the mounting port, and one end of the extension portion is connected to the connecting portion.

In this embodiment, the valve tongue comprises a connecting portion and an extension portion. The extension portion is located in the mounting port and can be connected to the valve sheet body through the connecting portion. The other positions of the extension portion are not connected to the valve sheet body. This configuration makes the valve tongue, except for one side wall of the connecting portion connected to the valve sheet body, and there is a gap between the edge of the remaining part and the mounting port. Therefore, the shape of the inner diameter of the mounting port can be configured as required.

Furthermore, the connection between the extension portion and the connecting portion can be configured to be relatively narrow, which will make the valve tongue easier to open. When the valve tongue is closed, it will not slap the piston strongly and generate noise.

Furthermore, since the extension portion is only connected to the valve sheet body through the connecting portion, the shape of the mounting port can be independent of the extension portion, and only considers the fit with the piston, so that the piston can closely attach the valve sheet.

In the above-mentioned embodiments, a spacer groove is formed between the connecting portion and the valve sheet body, and one end of the spacer groove away from the mounting port forms a processing hole.

In this embodiment, by setting a spacer groove between the connecting portion and the valve sheet body, the valve tongue can be fully opened. It is understandable that because the piston attaches closely to the valve body, the valve tongue needs to be fully opened when the fluid passes through, so that the fluid can pass smoothly. Therefore, by setting a spacer groove on the edge of the connecting portion, the valve tongue can be opened longer, the valve tongue is also relatively easy to open, and the airflow is easier to pass through the piston assembly.

In order to increase the effect of opening the valve tongue, a processing hole is arranged at one end of the spacer groove away from the mounting port. The inner diameter of the processing hole can be adjusted as needed. On the basis of the same size of the valve tongue itself, by setting processing holes with different inner diameters, the connection strength between the connecting portion and the valve sheet body can be adjusted. For example, the larger the inner diameter of the processing hole, the smaller the width of the connection position between the connecting portion and the valve sheet body. Relatively speaking, the valve sheet is easier to open, but at the same time, the connection strength of the valve sheet is smaller.

In the above-mentioned embodiments, an end surface of one end of the valve sheet away from the piston coincides with an end surface of the piston where the cooperating groove is provided.

In this embodiment, by limiting the end surface of the piston with the cooperating groove to coincide with the end surface of the valve sheet away from the piston, thereby when the valve sheet attaches the piston and the valve tongue is not opened, the end surface of the piston is flush with the end surface of the valve sheet away from the piston. When the fluid is closed by the valve sheet, the flat end face will not cause the fluid to generate turbulence, which will cause noise.

Furthermore, if there are multiple valve tongues on the valve sheet, there can be multiple pistons sharing the same valve sheet, and the fluid shock generated by closing the valve tongue will not affect other valve tongues.

In the above-mentioned embodiments, a projection of the valve sheet on an axis of the piston is at least partially coincident with the piston, and the valve sheet is sleeved on one end of the piston.

In this embodiment, by sleeving the valve sheet on one end of the piston, the piston and the valve sheet can be further attached. On this basis, by limiting the at least partially overlapping part between the valve sheet and the piston in the axial direction. That is, the valve sheet is embedded at least at one end of the piston, so that the gap between the two in the axial direction will be smaller. On the one hand, it is conducive to the reduction of the axial size, on the other hand, it is also conducive to reducing the impact of the fluid on the mounting port when the fluid flows, thereby reducing noise.

In the above-mentioned embodiments, the valve sheet body and the valve tongue are integrally formed.

In this embodiment, the valve sheet body and the valve tongue are integrally formed. Compared with other methods, the connection strength is greater in this way, and unnecessary connection structures are reduced. Therefore, the connection position of the valve tongue and the valve sheet body can be configured to be relatively narrow, making the valve tongue easier to be opened by the fluid. In addition, due to the integrated structure, the connection between the valve tongue and the valve sheet can be smoother and better attach the piston assembly.

When the valve tongue closes the fluid channel, it fits closely with the end face of the piston and can completely close the fluid channel.

The compressor assembly provided by the embodiment of the second aspect of the present disclosure, including a compressor, being provided with a suction port, and the piston assembly provided in the first aspect of the embodiment, being arranged at the suction port.

The compressor assembly provided by the embodiment of the second aspect of the present disclosure, including a compressor and a piston assembly. The piston assembly is arranged at the suction port. The gas passing through the suction port can open and close the gas passage through the piston assembly, thereby opening and closing the passage of the gas fed into the compressor.

Since the compressor assembly comprises any one of the piston assemblies in the embodiment of above-mentioned first aspect, the compressor assembly also has any beneficial effect of the embodiment of the above-mentioned first aspect, which will not be repeated here.

Because the piston assembly can allow the incoming gas to fully enter the compressor through the piston, and improve the performance of the compressor, the performance of the compressor assembly will also be improved.

The refrigeration device provided by the embodiment of the third aspect of the present disclosure, including a shell, and the compressor assembly provided in the second aspect of the embodiment, being arranged in the shell.

The refrigeration device provided by the embodiment according to the third aspect of the present disclosure comprises a shell and a compressor assembly being arranged in the shell. The shell provides a protective effect, and the compressor assembly comprises a piston assembly. Therefore, the refrigeration device has the characteristics of low noise and high performance.

The refrigeration device can be refrigerators, freezers, air conditioners and other devices that can be refrigerated.

For example, since the refrigeration device comprises any one of the compressor assemblies in the second aspect of the embodiment, it has any beneficial effect of the second aspect of the embodiment, which will not be repeated here.

Additional aspects and advantages of the present disclosure will become apparent in the following description or will be learned by practice of the present disclosure.

The corresponding relationship between the reference signs and component names in FIG. 1 to FIG. 11 is as follows:

1: piston assembly, 2: compressor assembly, 3: refrigeration device, 102: piston, 104: cooperating groove, 106: valve sheet, 108: mounting port, 110: valve sheet body, 112: valve tongue, 114: connecting portion, 116: extension portion, 118: processing hole, 120: spacer groove, 202: suction port, 204: compressor, 302: shell.

DETAILED DESCRIPTION OF EMBODIMENTS

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

Hereinafter, some embodiments according to the present disclosure will be described with reference to FIGS. 1-11.

Embodiment 1

Figure 2:
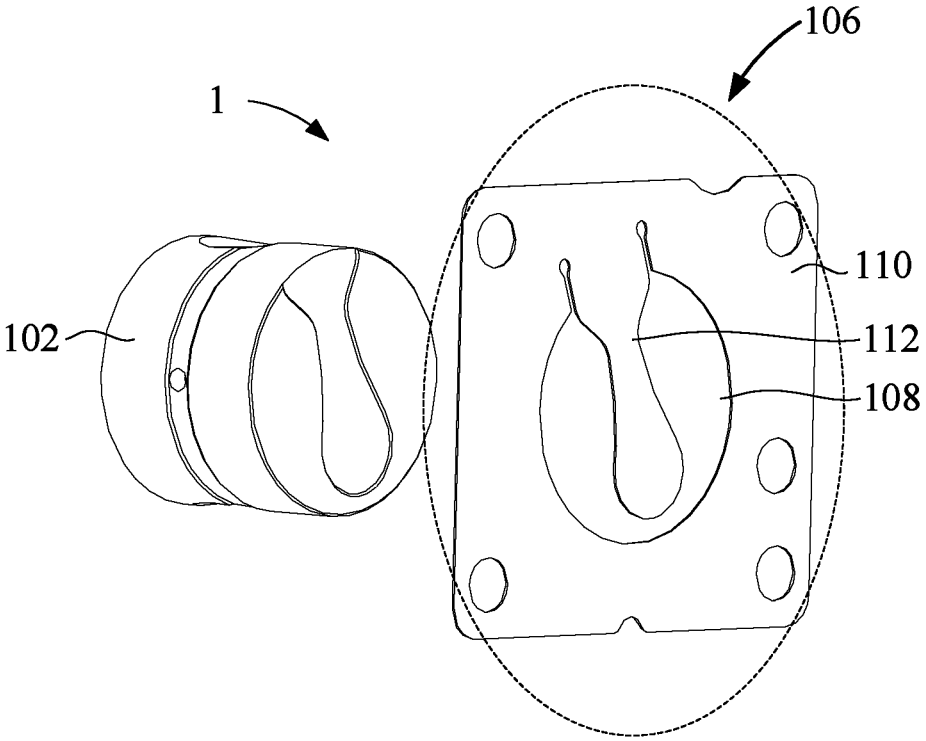
FIG. 2 shows a structural schematic diagram of a piston assembly of an embodiment according to the present disclosure.

As shown in FIG. 2, the embodiment provides a piston assembly 1, including a piston 102 and a valve sheet 106. The valve sheet 106 is arranged at one end of the piston 102. The valve sheet 106 comprises a valve sheet body 110 and a valve tongue 112. The valve sheet body 110 is provided with a mounting port 108, and the valve tongue 112 is arranged in the mounting port 108.

In order to ensure the normal operation of the valve tongue 112, when the valve sheet 106 is arranged at one end of the piston 102, the valve tongue 112 is located in the mounting port 108 of the valve sheet body 110. By matching part or an entire contour of the mounting port 108 with the circumferential contour of one end of the piston 102 close to the valve sheet 106, when the piston 102 attaches the valve sheet 106, the piston 102 can fit closely with the valve sheet 106 to prevent fluid from passing through the gap. When the valve tongue 112 is opened, fluid can flow through the gap between the valve tongue 112 and the piston 102. It should be emphasized that because the piston 102 matches with the valve sheet 106, the gap between the valve tongue 112 and the contour of the mounting port 108 can be increased, and the valve sheet body 110 will not generate vibration and noise due to excitation when the fluid flows. Furthermore, when the piston assembly 1 is used for a refrigeration device 3, because the piston 102 and the valve sheet 106 are closely matched, the clearance volume can be reduced. Therefore, the cooling capacity is increased, and the cooling performance is improved.

Figure 1:
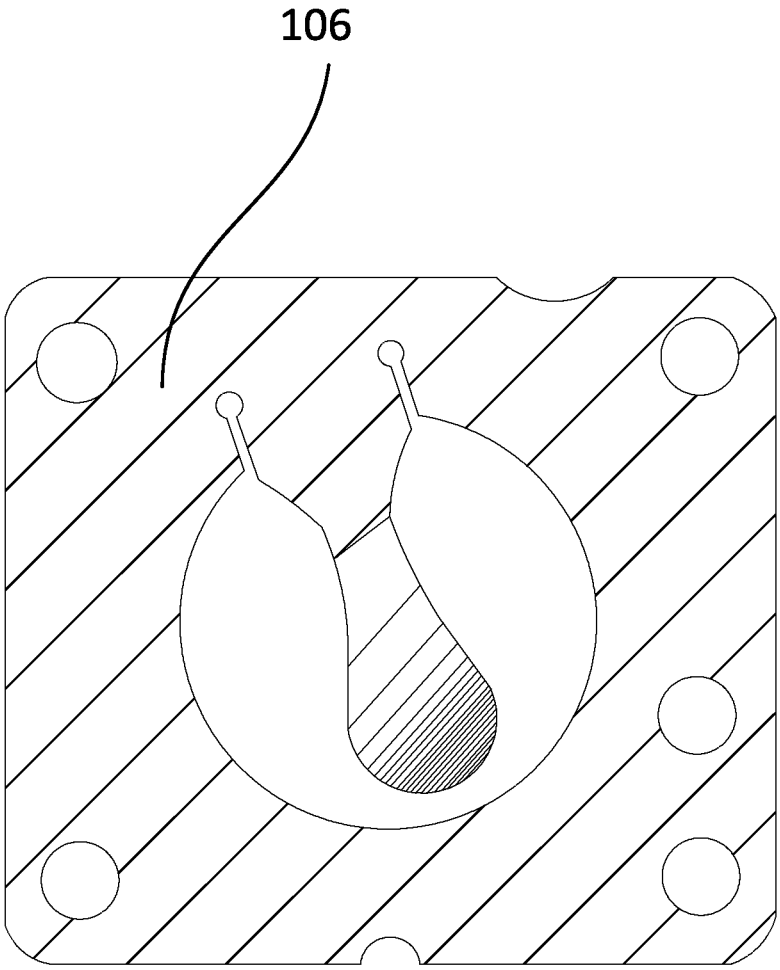
FIG. 1 shows an effect diagram of reducing noise when fluid passes through a piston assembly according to an embodiment of the present application.

As shown in FIG. 1, it shows the structural deformation cloud image when performing modal simulation according to the valve sheet 106 shown in this embodiment. It can be found that the force around the valve tongue 112 is relatively even. By adopting the valve sheet 106 that the shape matches with the piston 102, the valve sheet 106 is not excited by the fluid flow except the valve tongue 112, which can greatly reduce the noise generated by the fluid flow.

Furthermore, one end of the piston 102 close to the valve sheet 106 matches with the contour of the mounting port 108. When the fluid passes through, the fluid can only pass through the mounting port 108. It can be understood that the larger the area where the fluid can flow in the mounting port 108, the smaller the excitation of the valve sheet 106 when the fluid flows, and the smaller the noise of the valve sheet 106. Therefore, the mounting port 108 should be configured as large as possible to reduce the noise generated when the fluid passes. For example, the shape of the mounting port 108 can also be configured according to actual needs.

It should be noted that the structure that matches with the end face of the piston 102 can be a full mounting port 108 or a part of the mounting port 108 to achieve a close fit between the piston 102 and the valve sheet 106.

The number of the mounting ports 108 can be adaptively set according to actual use needs. It can be one or more to improve the utilization of valve sheet 106.

For example, the valve tongue 112 can also be set to one or more to control independent fluid channels respectively.

Furthermore, the valve tongue 112 can be configured to have different shapes according to actual needs. For example, the valve tongue can be rectangular, which is easy to process. However, when it is impacted by fluid, due to its wider junction with the valve sheet body 110, it requires a larger fluid impulse to push it away. It can also be configured to have a narrow top and a wide bottom. This shape is relatively easier to be opened by fluid, and is more suitable for the use of gas valve. Considering the actual application environment of the piston assembly 1, the size of the piston assembly 1 installation space and other factors, it can be configured adaptively according to actual needs.

The valve tongue 112 and the valve sheet body 110 can be connected by welding. The valve tongue 112 can be processed separately and then welded to the valve sheet 106. For example, it can also be a one-piece structure. This structure has higher connection strength and longer service life.

In an exemplary embodiment, the valve tongue 112 in the mounting port 108 is set to one or more. The valve tongue 112 independently controls different fluid channels.

In another exemplary embodiment, the valve sheet body 110 is provided with multiple mounting ports 108, and different mounting ports 108 are each provided with a different valve tongue 112, which can improve the utilization rate of the valve sheet 106.

Embodiment 2

Figure 3:
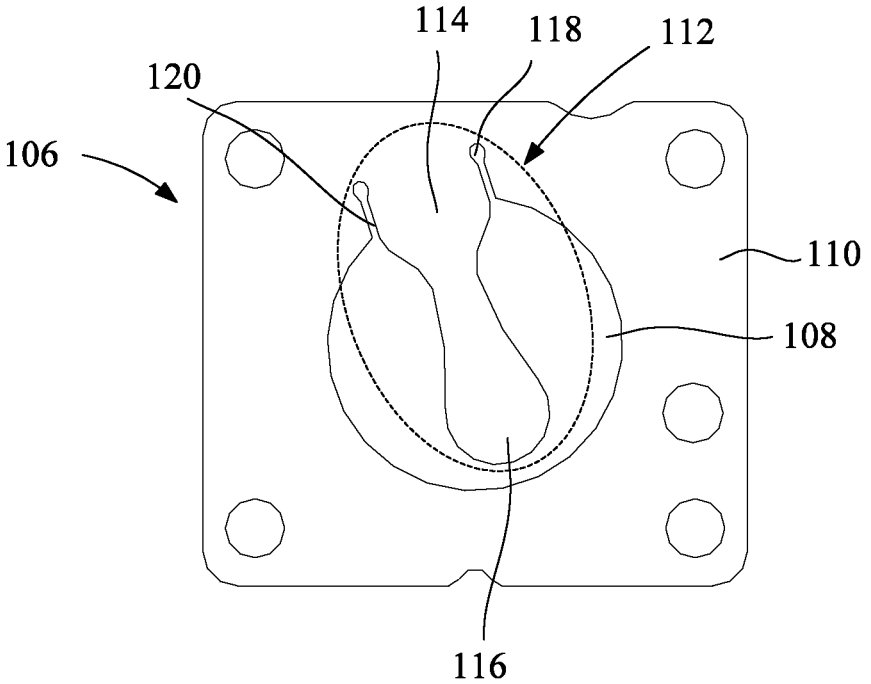
FIG. 3 shows a structural schematic diagram of a valve sheet of an embodiment according to the present disclosure.
Figure 4:
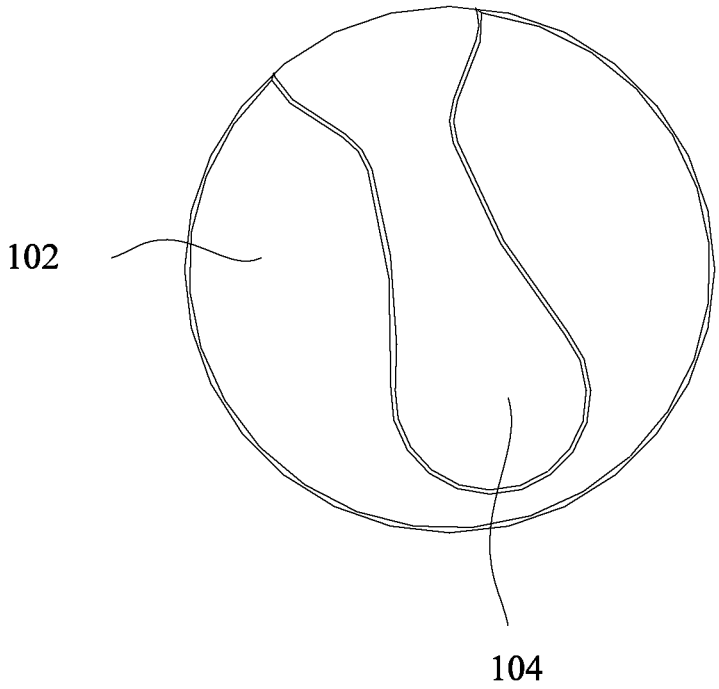
FIG. 4 shows a structural schematic diagram of a piston of an embodiment according to the present disclosure.
Figure 5:
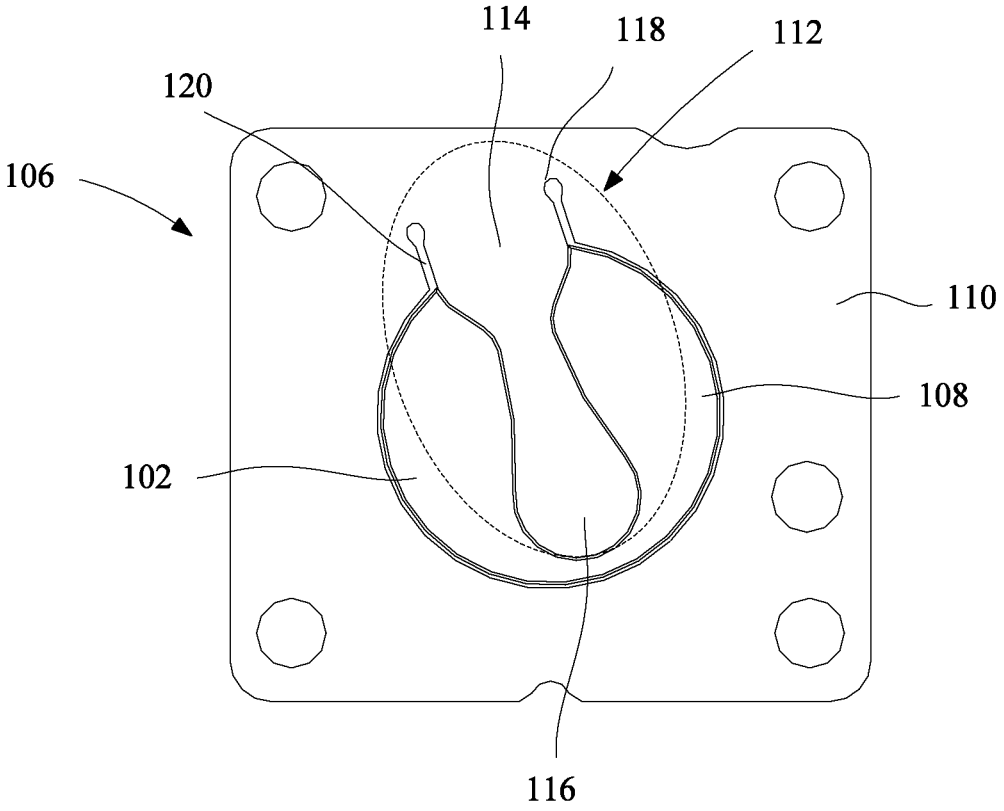
FIG. 5 shows a structural schematic diagram of a valve sheet of an embodiment according to the present disclosure.

As shown in FIGS. 3 and 4, this embodiment provides a piston assembly 1, including a piston 102 and a valve sheet 106. The valve sheet 106 is arranged at one end of the piston 102. The valve sheet 106 comprises a valve sheet body 110 and a valve tongue 112. The valve sheet body 110 is provided with a mounting port 108, and the valve tongue 112 is arranged inside the mounting port 108.

In order to ensure the normal operation of the valve tongue 112, when the valve sheet 106 is arranged at one end of the piston 102, the valve tongue 112 is located in the mounting port 108 of the valve sheet body 110. By matching at least part contour of the mounting port 108 with the circumferential contour of one end of the piston 102 close to the valve sheet 106, when the piston 102 attaches the valve sheet 106, the piston 102 can fit closely with the valve sheet 106 to prevent fluid from passing through the gap. When the valve tongue 112 is opened, fluid can flow through the gap between the valve tongue 112 and the piston 102. It should be emphasized that because the piston 102 matches with the valve sheet 106, the gap between the valve tongue 112 and the contour of the mounting port 108 can be increased, and the valve sheet body 110 will not generate vibration and noise due to excitation when the fluid flows. Furthermore, when the piston assembly 1 is used for refrigeration device 3, because the piston 102 and the valve sheet 106 are closely matched, the clearance volume can be reduced. Therefore, the cooling capacity is increased, and the cooling performance is improved.

Furthermore, one end of the piston 102 close to the valve sheet 106 matches with the contour of the mounting port 108. When the fluid passes through, the fluid can only pass through the mounting port 108. It can be understood that the larger the area where the fluid can flow in the mounting port 108, the smaller the excitation of the valve sheet 106 when the fluid flows, and the smaller the noise of the valve sheet 106. Therefore, the mounting port 108 should be configured as large as possible to reduce the noise generated when the fluid passes. For example, the shape of the mounting port 108 can also be configured according to actual needs.

It should be noted that the structure that matches with the end face of the piston 102 can be a full mounting port 108 or a part of the mounting port 108 to achieve a close fit between the piston 102 and the valve sheet 106.

The number of the mounting port 108*s* can be adaptively set according to actual use needs. It can be one or more to improve the utilization of valve sheet 106.

For example, the valve tongue 112 can also be set to one or more to control independent fluid channels respectively.

Furthermore, the valve tongue 112 can be configured to have different shapes according to actual needs. For example, the valve tongue can be rectangular, which is easy to process. However, when it is impacted by fluid, due to its wider junction with the valve sheet body 110, it requires a larger fluid impulse to push it away. It can also be configured to have a narrow top and a wide bottom. This shape is relatively easier to be opened by fluid, and is more suitable for the use of gas valve. Considering the actual application environment of the piston assembly 1, the size of the piston assembly 1 installation space and other factors, it can be configured adaptively according to actual needs.

The valve tongue 112 and the valve sheet body 110 can be connected by welding. The valve tongue 112 can be processed separately and then welded to the valve sheet 106. For example, it can also be a one-piece structure. This structure has higher connection strength and longer service life.

The extension portion 116 of the valve tongue 112 is in the mounting port 108 and is connected to the valve sheet body 110 through the connecting portion 114. No other positions of the extension portion 116 are connected to the valve sheet body 110. By this configuration, the valve tongue 112 is not connected to the valve body except the connecting portion 114 and the valve sheet body 110. Therefore, the mounting port 108 can be configured with the shape of the inner diameter as required.

The valve tongue 112 allows the connection between the extension portion 116 and the connecting portion 114 to be configured relatively narrow, which makes the valve tongue 112 easier to open. When the valve tongue 112 is closed, it will not slap the piston 102 strongly and generate noise. The relatively wide part of the lower part can effectively shut off the gas path of piston 102.

In an exemplary embodiment, the valve tongue 112 can be a rectangle, and the connecting portion 114 and the extension portion 116 have the same width. Compared with the valve tongue 112, which has a narrow upper and a lower width, the structure is simpler and can be fixed on the valve sheet 106 in an additional way.

Embodiment 3

On the basis of embodiment 2, as shown in FIG. 3, a spacer groove 120 is formed between the connecting portion 114 and the valve sheet body 110, so that the valve tongue 112 can be fully opened.

Because the piston 102 attaches closely to the valve body, the valve tongue 112 can be fully opened when the fluid passes through, so that the fluid can pass smoothly. By setting the spacer groove 120, the valve tongue 112 can be opened longer, so it can be opened at a larger angle. Furthermore, by setting the spacer groove 120, the openable length of the valve tongue 112 is longer, the valve tongue 112 is also relatively easier to open, and the airflow is easier to pass through the piston assembly 1.

Furthermore, in order to increase the effect of opening the valve tongue 112, a processing hole 118 is arranged at one end of the spacer groove 120 away from the mounting port 108. The inner diameter of the processing hole 118 can be adjusted as needed. On the basis of the same size of the valve tongue 112 itself. By setting processing holes 118 with different inner diameters, the connection strength between the connecting portion 114 and the valve sheet body 110 can be adjusted. For example, the larger the inner diameter of the processing hole 118, the smaller the width of the connection position between the connecting portion 114 and the valve sheet body 110. Thus, the valve sheet 106 is easier to open, but at the same time, the connection strength of the valve sheet 106 is smaller.

Embodiment 4

Figure 6:
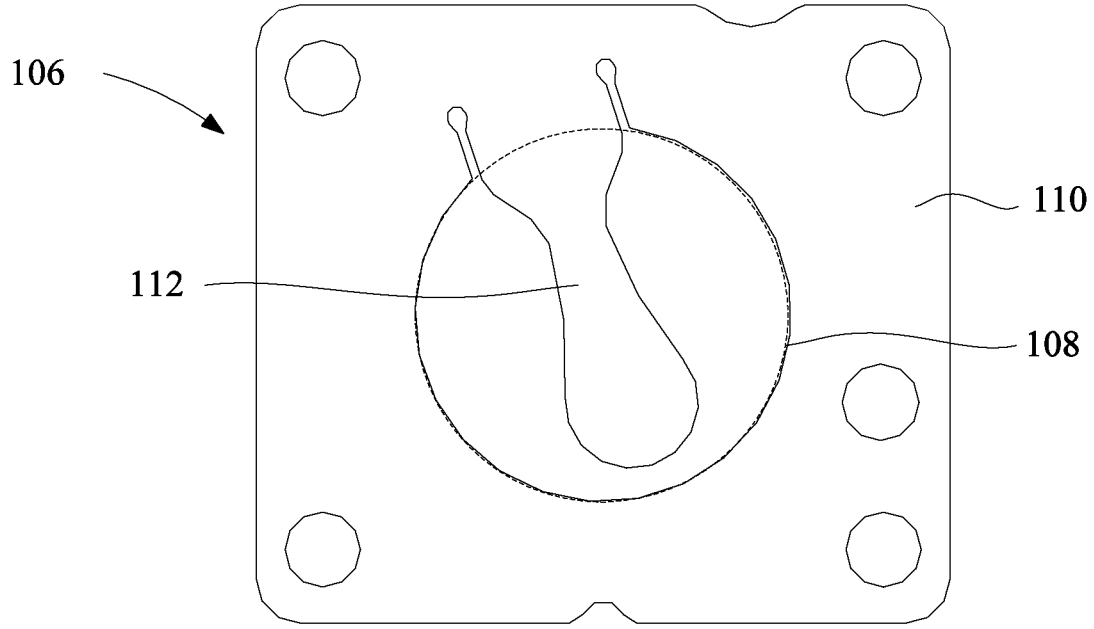
FIG. 6 shows a structural schematic diagram of a valve sheet of an embodiment according to the present disclosure.

As shown in FIG. 6, this embodiment provides a piston assembly 1, including a piston 102 and a valve sheet 106. The valve sheet 106 is arranged at one end of piston 102. The valve sheet 106 comprises a valve sheet body 110 and a valve tongue 112. The valve sheet body 110 is provided with a mounting port 108, and the shape of the mounting port 108 is as shown in FIG. 6. Part of the mounting port 108 matches with the end surface of the piston 102 close to one end of the valve sheet 106. Part of the valve tongue 112 is arranged inside the mounting port 108. The spacer groove 120 of the valve sheet body 110 and the processing hole 118 are arranged outside the mounting port 108.

When the piston 102 attaches the valve sheet 106, the piston 102 can fit closely with the valve sheet 106 to prevent fluid from passing through the gap. The valve tongue 112 is arranged inside the mounting port 108. When the valve tongue 112 is opened, fluid can flow through the gap between the valve tongue 112 and the piston 102. At this time, because the piston 102 and the valve sheet 106 are closely matched, the valve sheet body 110 will not generate vibration and noise due to the excitation when the fluid flows. Furthermore, when the piston assembly 1 is used for the refrigeration device 3, because the piston 102 and the valve sheet 106 are closely matched, the clearance volume can be reduced. Therefore, the cooling capacity is increased, and the cooling performance is improved.

Embodiment 5

Figure 7:
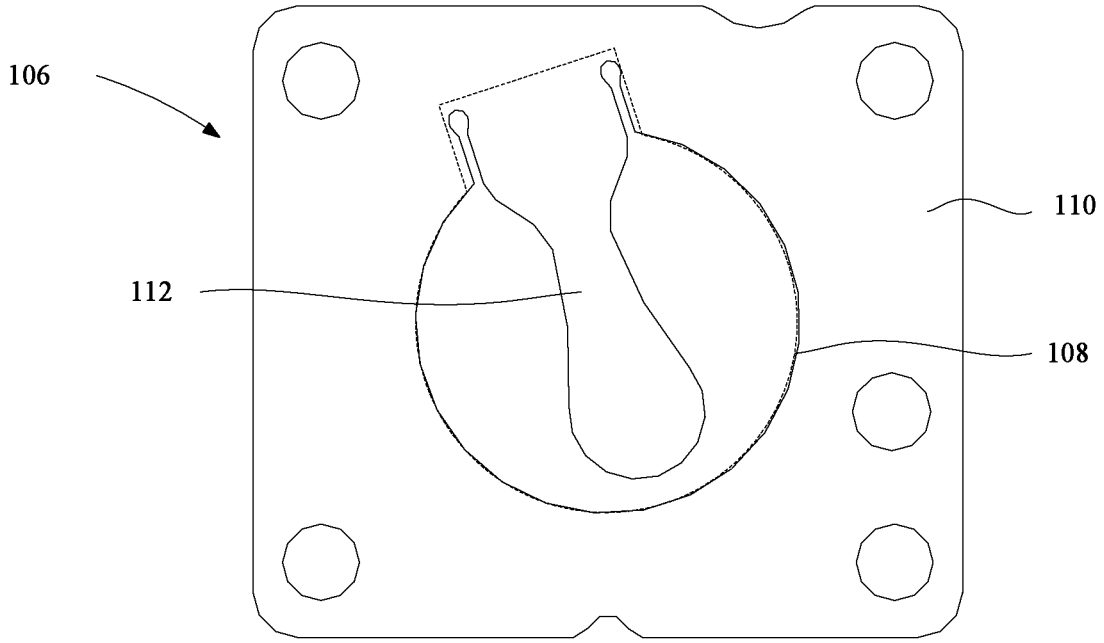
FIG. 7 shows a structural schematic diagram of a valve sheet of an embodiment according to the present disclosure.
Figure 8:
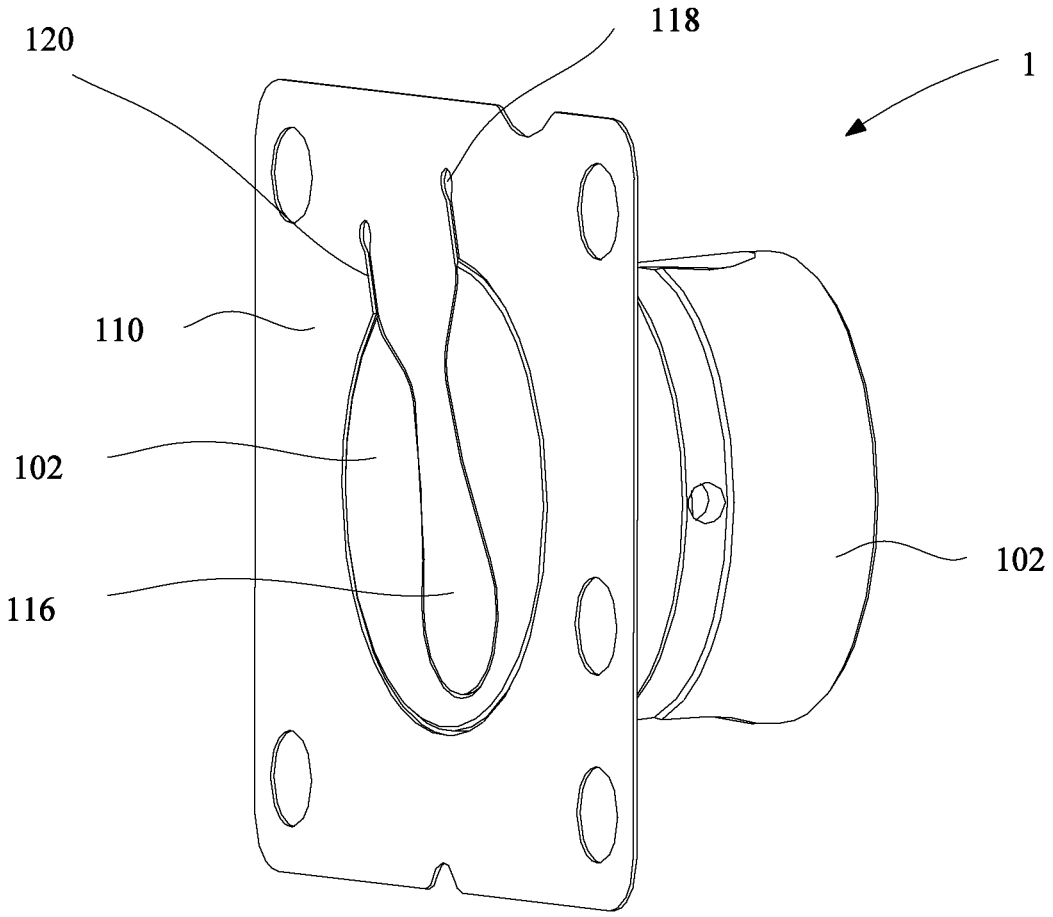
FIG. 8 shows a structural schematic diagram of a piston assembly of an embodiment according to the present disclosure.

As shown in FIG. 7, this embodiment provides a piston assembly 1, including a piston 102 and a valve sheet 106. The valve sheet 106 is arranged at one end of piston 102. The valve sheet 106 comprises a valve sheet body 110 and a valve tongue 112. The valve sheet body 110 is provided with a mounting port 108, and the shape of the mounting port 108 is as shown in FIG. 7. Part of the mounting port 108 matches with the end surface of the piston 102 close to one end of the valve sheet 106. Part of the valve tongue 112 is arranged inside the mounting port 108. The spacer groove 120 of the valve sheet body 110 and the processing hole 118 are arranged outside the mounting port 108.

When the piston 102 attaches the valve sheet 106, the piston 102 can attach closely with the valve sheet 106 to prevent fluid from passing through the gap. There is a valve tongue 112 in the mounting port 108. When the valve tongue 112 is opened, fluid can flow through the gap between the valve tongue 112 and the piston 102. At this time, because the piston 102 and the valve sheet 106 are closely matched, the valve sheet body 110 will not generate vibration and noise due to the excitation when the fluid flows. Furthermore, when the piston assembly 1 is used for the refrigeration device 3, because the piston 102 and the valve sheet 106 are closely matched, the clearance volume can be reduced. Therefore, the cooling capacity is increased, and the cooling performance is improved.

Embodiment 6

On the basis of any one of the above-mentioned embodiments, the structure of the piston assembly 1 is further defined. As shown in FIG. 3, the valve sheet body 110 and the valve tongue 112 are integrally formed. This way, compared with other ways, the connection strength is higher. Therefore, the connection position of the valve tongue 112 and the valve sheet body 110 can be configured to be relatively narrow, making valve tongue 112 easier to be opened by fluid. Secondly, the connection between the valve tongue 112 and the valve sheet 106 can be smoother, and then better attach the piston assembly 1. When the valve tongue 112 closes the fluid channel, it attaches closely with the end surface of the piston 102, which can completely close the fluid channel.

In an exemplary embodiment, the connecting portion 114 of the valve tongue 112 is connected to the valve sheet 106 by spot welding. At the position where the connecting portion 114 is electrically welded to the valve sheet 106, there are several welding spots. In this way, when needed, the valve tongue 112 can be added to the valve sheet 106 by spot welding to change the knot of the piston assembly 1. However, the electric welding method is relatively weaker than the one-piece molding. First, the connection strength is poor, and the valve tongue 112 may be repeatedly opened and closed, and the valve tongue 112 may fall off the valve sheet 106. Secondly, the spot welding is not flat, and the fit between the valve sheet 106 and the end surface of the piston 102 will create a gap due to the unevenness caused by the spot welding, and eventually the valve tongue 112 cannot completely close the piston 102, causing air leakage.

Embodiment 7

On the basis of any one of the above-mentioned embodiments, the structure of piston assembly 1 is further defined as shown in FIGS. 3, 4, 5 and 8, a cooperating groove 104 is provided at one end of the piston 102 close to the valve sheet 106, and the shape of the cooperating groove 104 matches with the shape of the valve tongue 112. When the piston 102 is matched with the mounting port 108, the valve tongue 112 can be embedded in the cooperating groove 104 to further make the valve sheet 106 and the piston 102 attach closely without leaving a gap between the two. In this way, when the valve tongue 112 is opened and the fluid passes through, the fluid will not leak from the gap between the valve tongue 112 and the piston 102, causing noise. At the same time, because the valve body is closely attached to the piston 102, the fluid flowing through the mounting port 108 can all enter into the piston 102. For the refrigeration device 3 using piston assembly 1, the fluid can flow in more fully, which increases the cooling capacity and achieves the dual goal of noise reduction and improvement of cooling performance.

Figure 9:
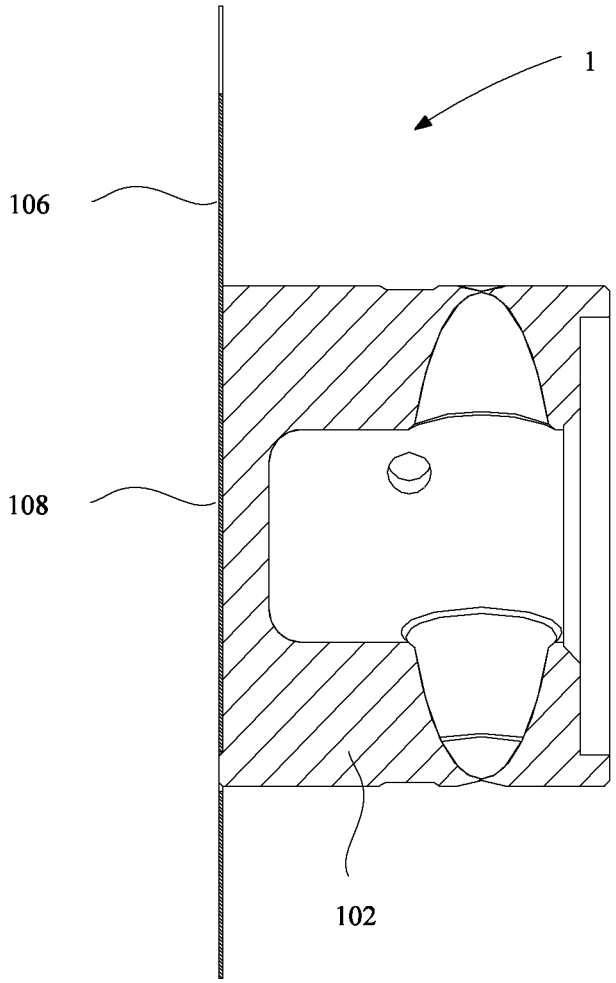
FIG. 9 shows a structural schematic diagram of a piston assembly of an embodiment according to the present disclosure.

Furthermore, as shown in FIG. 9, the thickness of the valve tongue 112 and the cooperating groove 104 are equal. When the valve tongue 112 is closed, the valve tongue 112 can be completely embedded in the cooperating groove 104. When the valve body is attached to the piston 102, the thickness is the same, and there is no gap between the two, and they can be closely attached to each other. For the refrigeration device 3, the valve body, especially the valve joint, attaches closely with the end face of piston 102, so that no fluid remains between the valve tongue 112 and the piston 102, thereby increasing the cooling capacity.

In an exemplary embodiment, the end surface of the piston 102 for providing the cooperating groove 104 coincides with the end surface of the valve sheet 106 away from the piston 102. In this way, when the valve sheet 106 attaches the piston 102 and when the valve tongue 112 is not opened, the end surface of the piston 102 is flush with the end surface of the valve sheet 106 away from the piston 102. When the fluid is closed by the valve sheet 106, the flat end face will not cause turbulence in the fluid, which will cause noise.

Furthermore, if there are multiple valve tongues 112 provided on the valve sheet 106, there can be multiple pistons 102 sharing one valve sheet 106, and the fluid impact generated by closing the valve tongue 112 will not affect other valve tongue 112.

In another exemplary embodiment, the valve sheet 106 is sleeved on one end of the piston 102, and the piston 102 and the valve sheet 106 can be further attached. It can be understood that the inner diameter of the mounting port 108 should be slightly larger than the outer diameter of the piston 102, and the piston 102 attaches closely with the mounting port 108 of the valve sheet 106. In this way, when the fluid passes through the port of the piston 102, it is farther from the axial inner wall of the mounting port 108, and will not impact the mounting port 108 and cause noise. In addition, there will no longer be a gap between the valve sheet 106 and the end surface of the piston 102, and then there will be fluid. When the valve tongue 112 is opened, the fluid can completely pass through the piston 102.

Embodiment 8

Figure 10:
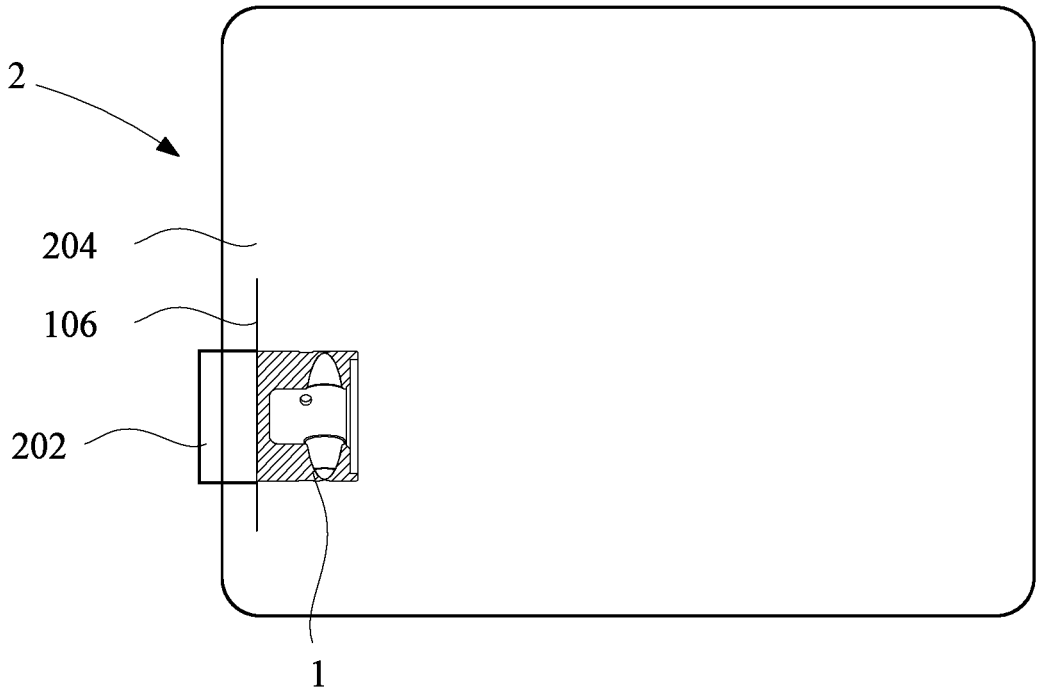
FIG. 10 shows a structural schematic diagram of a compressor assembly of an embodiment according to the present disclosure.

As shown in FIG. 10, this embodiment provides a compressor assembly 2, including a compressor 204, such as a piston assembly 1 of any one of the above-mentioned embodiments. The compressor 204 is provided with a suction port 202, the piston assembly 1 is arranged at the suction port 202. The gas passing through the suction port 202 will be able to open and close the gas channel due to piston assembly 1, so as to realize the opening and closing of the gas channel fed into the compressor 204. Since the piston assembly 1 has the beneficial effect of reducing noise, the compressor assembly 2 also has any beneficial effect of any one of embodiments, which will not be repeated here.

Due to the piston assembly 1, the gas that enters into the piston assembly 1 can completely enter into the compressor 204 through the piston 102. Thus, the performance of the compressor 204 is improved, and the performance of the compressor assembly 2 is also be improved.

Embodiment 9

Figure 11:
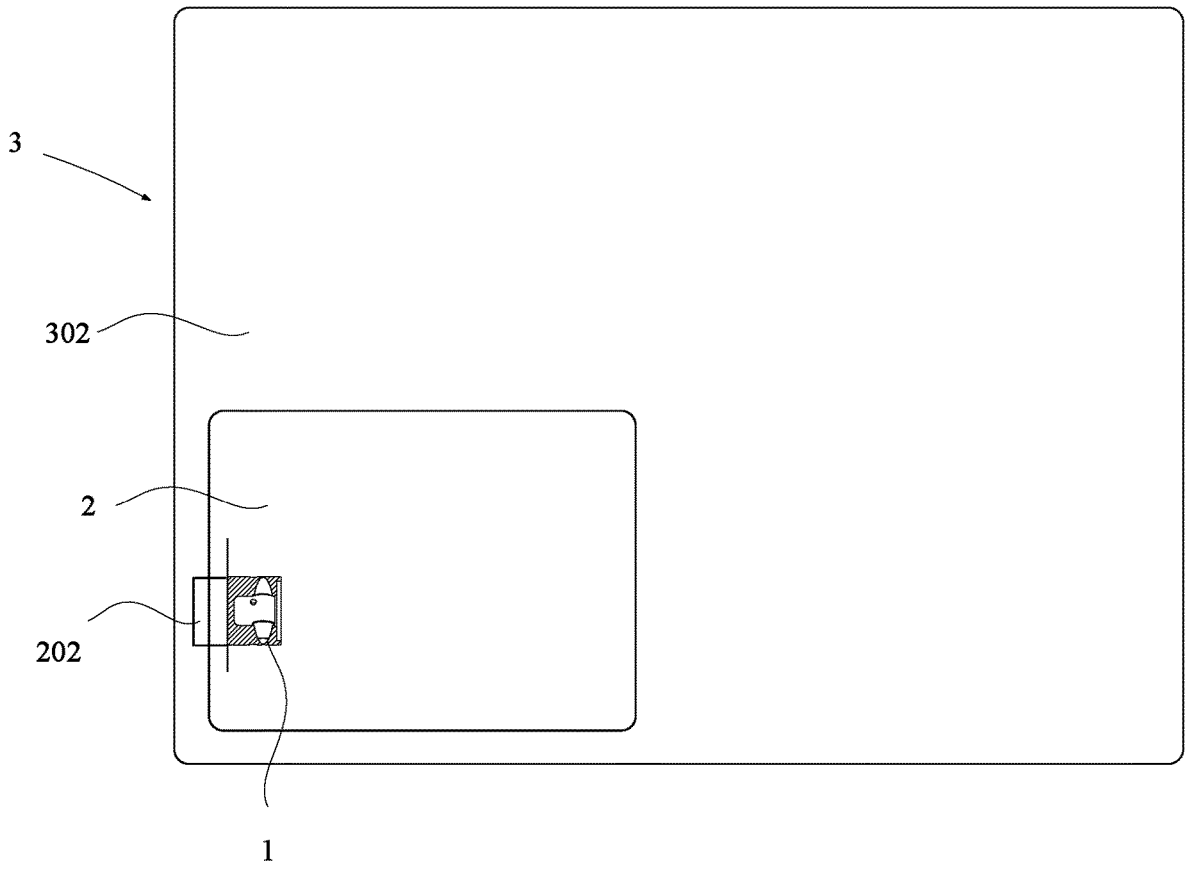
FIG. 11 shows a structural schematic diagram of a refrigeration device of an embodiment according to the present disclosure.

As shown in FIG. 11, this embodiment provides a refrigeration device 3, including a shell 302, and any compressor assembly 2 in the above-mentioned second aspect of the embodiment. The compressor assembly 2 is arranged in the shell.

The shell 302 of the refrigeration device 3 is provided with a compressor assembly 2 and the compressor assembly 2 comprises a piston assembly 1 according to the first aspect of the embodiment. Therefore, the refrigeration device 3 has the characteristics of low noise and high performance. For example, since the refrigeration device 3 comprises the compressor assembly 2 of the above-mentioned embodiment 8, it has any beneficial effect of the first aspect of the embodiment, which will not be repeated here.

According to the piston assembly, the compressor assembly and the refrigeration device in the embodiment of the present disclosure, the mounting port is arranged on the valve sheet, and the contour of the mounting port matches with one end of the piston close to the valve sheet. This increases the gap between the valve tongue and the contour of the mounting port, and reduces the noise generated by the valve sheet being excited by the fluid. For the refrigeration device, the end surface of the piston close to the valve sheet is provided with a cooperating groove, which can reduce the clearance volume and increase the cooling capacity. Thus, the dual goals of improving the cooling performance and reducing the noise are achieved, which ensures the overall performance of the compressor.

In the description of the present disclosure, the terms "first", "second", and "third" are only used for descriptive purposes, and cannot be understood as indicating or implying relative importance; the term "plurality" refers to two or more, unless explicitly defined otherwise. The terms "mounted", "connected", "connecting", "fixed", and the like are to be construed broadly, e.g., "connecting" may be a fixed connection, a removable connection, or an integral connection; "connected" may be directly connected or indirectly connected by an intermediary. The specific meaning of the above terms in this application will be understood in specific circumstances by those of ordinary skill in the art.

In the description of the present disclosure, it should be understood that the terms "up", "down", "left", "right", "front", "rear" and other directions or positional relationships are based on the attached drawings. The orientation or positional relationship is only for the convenience of describing the present disclosure and simplifying the description, rather than indicating or implying that the device or unit referred to must have a specific orientation, and be constructed and operated in a specific orientation. Therefore, it cannot be understood as a restriction on the present disclosure.

In the description of the present disclosure, reference to the terms "an embodiment", "some embodiments", and "a specific embodiment", etc., means that specific features, structures, materials, or characteristics described in connection with the embodiment or example is included in at least one embodiment or example of the application. In the present specification, schematic statements of the above terms do not necessarily refer to the same embodiment or example. Furthermore, the particular features, structures, materials, or characteristics described may be combined in any suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. A piston assembly comprising:

a piston; and a valve sheet arranged at one end of the piston closer to the valve sheet, wherein the valve sheet comprises:

a valve sheet body defining a mounting port; and a valve tongue connected to the valve sheet body, wherein the one end of the piston closer to the valve sheet is provided with a cooperating groove, and a shape of the cooperating groove matches with a shape of the valve tongue, wherein the valve tongue comprises:

a connecting portion connected to the valve sheet body;

an extension portion arranged in the contour of the mounting port; and a connection portion configured to connect the connecting portion and the extension portion, wherein the extension portion is connected to the valve sheet body only through the connection portion and the connecting portion, wherein the valve tongue extends in an extending direction, wherein a part of the connecting portion is arranged in the mounting port, wherein a width of the connection portion along the extending direction is narrower than a width of the connecting portion along the extending direction and a width of the extension portion along the extending direction, wherein a contour of the mounting port is circular except where the part of the connecting portion that is arranged in the mounting port is provided, wherein a circumferential contour of the one end of the piston matches the contour of the mounting port, and wherein a spacer groove is formed between the connecting portion and the valve sheet body, and one end of the spacer groove away from the mounting port forms a processing hole, where the width of the connecting portion adjacent to the processing hole is smaller than a width of the connecting portion adjacent to the spacer groove.

2. The piston assembly according to claim 1, wherein a thickness of the valve tongue is equal to a thickness of the cooperating groove.

3. The piston assembly according to claim 1, wherein an end surface of one end of the valve sheet away from the piston coincides with an end surface of the piston where the cooperating groove is provided.

4. The piston assembly according to claim 1, wherein:

a projection of the valve sheet on an axis of the piston is at least partially coincident with the piston, and the valve sheet is sleeved on one end of the piston.

5. The piston assembly according to claim 1, wherein the valve sheet body and the valve tongue are integrally formed.

6. A compressor assembly comprising:

a compressor comprising a suction port; and the piston assembly according to claim 1, being arranged at the suction port.

7. A refrigeration device comprising:

a shell; and the compressor assembly according to claim 6, being provided in the shell.

* * * * *